United States Patent [19]

Overturf

[11] Patent Number: 4,617,198

[45] Date of Patent: Oct. 14, 1986

[54] METHOD FOR MAKING ROOFING

[75] Inventor: John R. Overturf, Lancaster, Ohio

[73] Assignee: Transmet Corporation, Columbus, Ohio

[21] Appl. No.: 778,849

[22] Filed: Sep. 23, 1985

[51] Int. Cl.[4] ..... B05D 1/12; B05D 1/02

[52] U.S. Cl. ..... 427/186; 427/205; 427/241; 427/417; 427/424; 427/427

[58] Field of Search ..... 427/186, 205, 241, 417, 427/424, 427

[56] References Cited

U.S. PATENT DOCUMENTS 2,133,988 10/1938 Harshberger ..... 427/186
2,332,219 10/1943 Harshberger ..... 427/186
4,215,084 7/1980 Maringer ..... 264/8

FOREIGN PATENT DOCUMENTS 688690 6/1964 Canada ..... 427/186

*Primary Examiner*—John E. Kittle
*Assistant Examiner*—Patrick J. Ryan
*Attorney, Agent, or Firm*—Sidney W. Millard

[57] ABSTRACT

Roofing roll products are manufactured by method and apparatus which projects a plurality of aluminum chips onto a tacky upper surface of a base material such that the chips have a flat contiguous relationship to provide a protective layer on the upper surface of the roofing material.

14 Claims, 6 Drawing Figures

S
16
16a
11
27
22
23
24
15
17
28
12
S
19
2
2
32
14
37
38
36
13
35
S
33
13a 23
24
22
29
26
3
3
18
17
S
30
26
29
24
23

METHOD FOR MAKING ROOFING

BACKGROUND OF THE INVENTION AND PRIOR ART

This invention relates to roofing roll products and to a method and apparatus for making the same. It relates particularly to the use of chips or flakes of the type produced according to the method and apparatus disclosed in U.S. Pat. No. 4,215,084 applied to a bitumen substrate. The chips described in this patent are uniform in size and in the range of 20 to 30 mills square by 1 to 2 mills thick. However, the particle sizes could be larger or smaller but preferably rectangular in shape.

The present invention relates to the application of such chips, particularly aluminum chips, to a suitable base preferably in the form of a sheet or membrane coated with roofing asphalt or other bitumen material. The chips are applied uniformly in flat contiguous covering relationship so that they will shield the membrane from ultraviolet rays that oxidize and polymerize the roofing asphalt. The chips have a tough mirror-like finish which results in substantially increased solar reflectance as compared to conventional aluminum-asphalt roofing of the granular top surface type.

In the past, various methods and materials have been used in protecting the roofing base, usually in the form of a sheet or membrane, which may be reinforced or non-reinforced, and coated with asphalt or other suitable bonding material for receiving and retaining the protective material. This protective material has taken various forms in the prior art. For example, one of the most commonly used has been rock aggregate which is difficult and expensive to apply and does not have good solar reflective properties. Another conventional type used is aluminum paint which requires considerable labor to install and a waiting period to allow the base coat of asphalt to cure prior to the application of the paints and, although the resulting coating does have better reflective properties than the gravel, it is not the most effective to reduce internal building heat created via solar energy. In U.S. Pat. Nos. 2,133,988 and 2,332,219 a method has been proposed to increase the protection of an asphalt roofing membrane by applying a substantially continuous layer of finely divided aluminum flakes and then applying granular particles, such as crushed slag or pebbles, with sufficient force to slightly displace the aluminum particles so as to penetrate the layer of such particles and to become embedded in the asphalt. This process is also difficult and time-consuming to perform and the granular particles of the resulting coating detract from the solar resistance and reflective capabilities of the aluminum flake layer.

SUMMARY OF THE INVENTION

According to the present invention, chips of the type disclosed in U.S. Pat. No. 4,215,084 are applied to a suitable base uniformly in flat contiguous relationship with minimum overlapping so that a continuous protective reflective coating of flat chips results with a minimum of chips. The base may be in the form of various membranes or strips of material, either reinforced or non-reinforced, which carries a coating of heat-softened, tacky, asphalt or other bonding material.

The process of the present invention is a continuous process wherein the strip of base material may be supplied from a supply roll or other means and is moved at a selected speed beneath a chip-applying grooved roll of a special form. This roll rotates at a considerably faster speed than that of the moving strip material as the chips are deposited on the roll. The form of the grooves in the roll and the shape and size of the chips are so related that the chips are flung over the moving strip with considerable force so that they will tumble in flight, settle onto the bonding surface of the strip material and flop, flat side down, to thereby substantially cover the surface by a contiguous layer of the chips with a minimum of overlapping. The minimum of overlapping occurs because a tumbling chip will, by its momentum tend to tumble on the tacky surface until a flat side adheres. Additionally, a tumbling chip will slide off another chip which is already adhered and will slide until it encounters an uncovered section of adhesive where it will stick.

The chip-covered strip is then subjected to compressive pressure to further bond the chips to the base. Thus, a continuous reflective and protective layer of the chips is provided with a minimum use of the chips.

BRIEF DESCRIPTION OF THE DRAWINGS

The best mode contemplated in carrying out this invention is illustrated in the accompanying drawings in which.

DETAILED DESCRIPTION OF THE INVENTION

Figure 1:
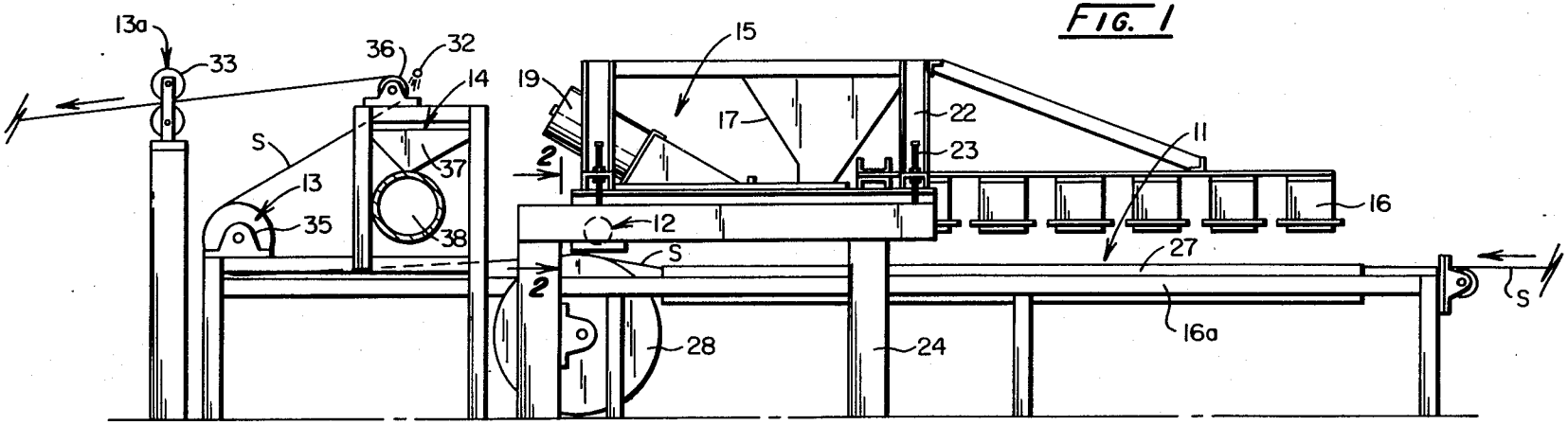
FIG. 1 is a side elevational view illustrating a machine suitable for performing the method of this invention.

As previously indicated, the present invention deals particularly with a method and apparatus for applying flakes or chips of the type disclosed in U.S. Pat. No. 4,215,084 to a base material in such a manner as to produce a roofing strip or membrane which is covered with the chips to provide a protective and reflective layer thereon. According to the method disclosed in that patent, the chips are produced by projecting a stream of molten metal upon the serrated surface of a rotating drum member to form chips on the connecting surfaces of the serrations. The metal may be aluminum, magnesium, tin or other metals and the shape of the chips is rectangular with a size ranging from 10 to 200 mils on a side by 1 to 2 mils thick. Preferably, the rectangular chip should be 60 to 80 mils on a side. To the extent necessary for complete understanding of this invention, U.S. Pat. No. 4,215,084 is incorporated herein by reference.

According to the present invention, aluminum chips are preferably used and are applied to a base material in the form of a strip or membrane coated with roofing asphalt or other bitumen material or any other suitable coating which is tacky or can be softened to a tacky consistency by heat. The membrane may be of various material such as paper, felt or plastic and may be non-reinforced or reinforced such as by glass fibers.

A machine suitable for carrying out the process of this invention is illustrated in FIGS. 1–4 of the drawings. With this machine, a strip S of the base material to be covered by the chips is pulled continuously through the machine and is subjected successively to a temperature-controlling unit 11, a chip-applying unit 12, a unit 13 for pressing the chips into the base material, a unit 14 for removing surplus chips and another pressure-applying unit 13*a*. Cooperating with the chip-applying unit 12 is a unit 15 for supplying the chips and feeding them to the chip-applying unit.

The strip S may be previously manufactured and supplied to the machine from a supply roll or it may be received by the machine as it is manufactured as indicated in the example shown. This strip may be in the form of a suitable base or membrane coated with asphalt which will be hot as received by the machine. It will be pulled continuously through the machine and first will pass through the temperature-controlling unit 11. This temperature-contolling unit may include a chill plate or lower water-bath 16*a* and an upper heating means 16. If the strip is hot as supplied, it will pass through the water-bath 16*a*. If it is cool as supplied, the heating means 16 will be used to bring the asphalt surface up to the proper temperature for receiving the chips. The object of the heat control unit is to have a strip with a soft, tacky upper surface to receive the chips and a suitably coated or congealed lower surface which will not stick to the machinery.

Figure 2:
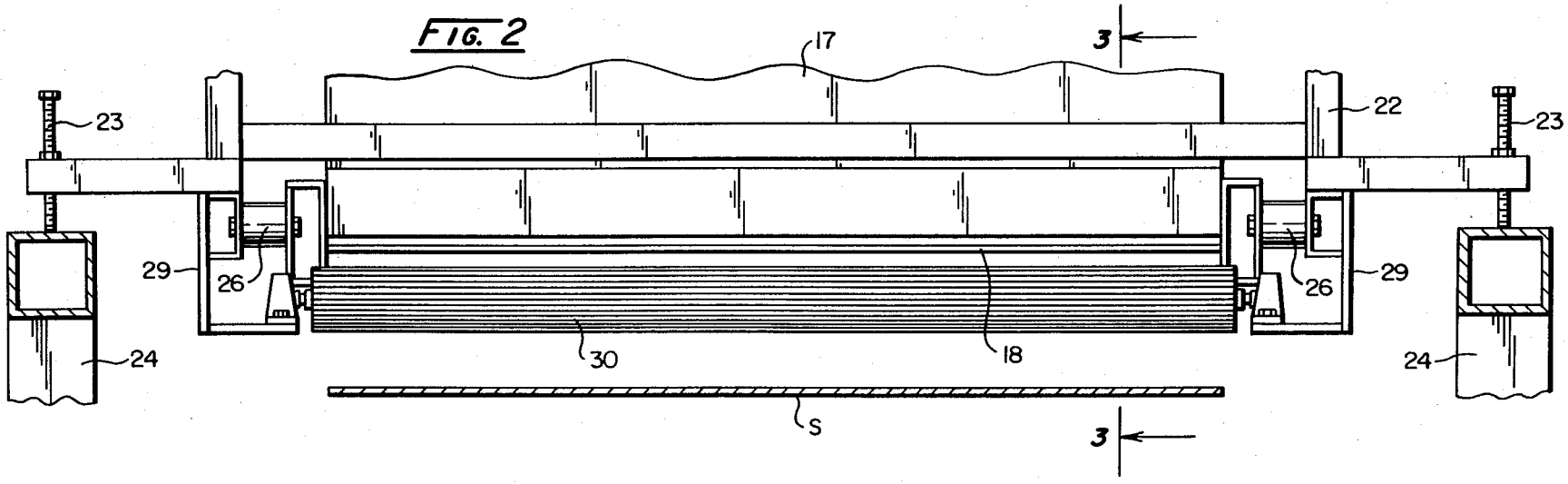
FIG. 2 is an enlarged transverse vertical sectional view taken along line 2—2 of FIG. 1.
Figure 3:
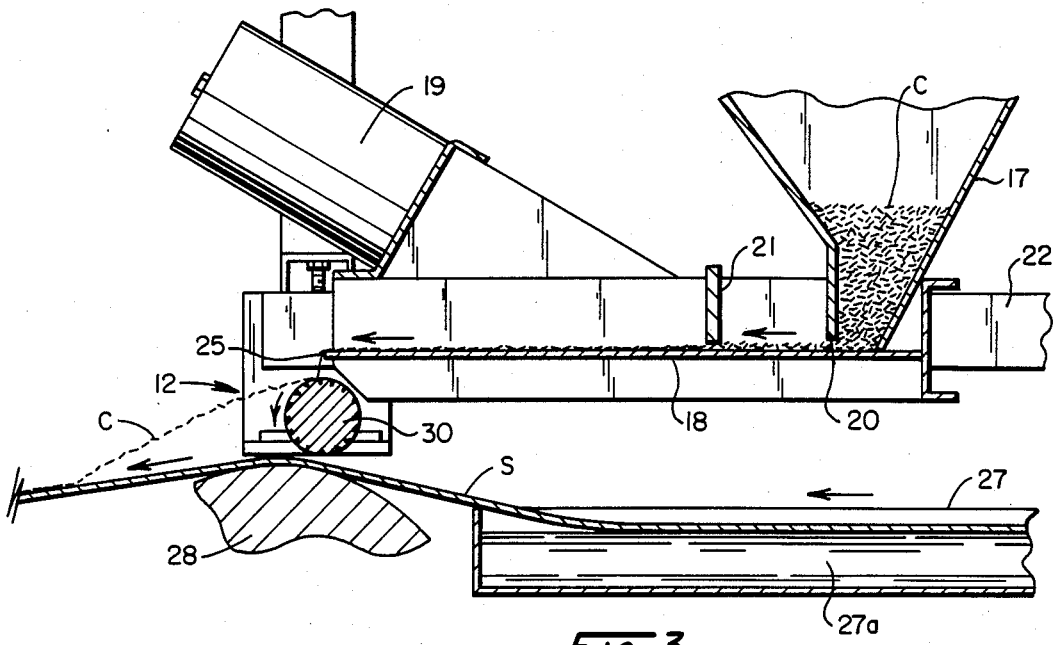
FIG. 3 is a vertical sectional view taken along line 3—3 of FIG. 2.

The chip-supplying unit 15 may take various forms but is shown in FIGS. 1–3 as including a hopper 17 which receives a supply of the chips and feeds them onto a vibrator plate 18. This plate 18 is vibrated by a suitably controlled vibrator motor 19 to feed the chips at a suitable rate from the supply hopper 17 to the chip-applying unit 12. At the bottom of the hopper 17, a vertically adjustable gate 20 is provided to insure that a uniform layer of chips deposits on the vibrator plate 18. As the chips are fed along on the vibrator plate, a second vertically-adjustable gate 21 controls the depth of the layer of chips. The entire chip supplying unit 15 may be supported by a frame 22 which provides for vertical adjustment by the rods 23 which are supported by a base frame 24. The vibrator 19 may be adjusted to provide the proper rate of feed of the chips from the supply hopper 17 along the vibrator plate 18 to its discharge edge 25 (FIG. 3). It will be noted (FIG. 2) that the plate 18 is supported from the frame 22 by yieldable spacers 26.

The hot strip S is carried over the water-bath 16*a* and will float on the water. The water bath will control the temperature of the strip S to insure that the bottom surface is not soft and will not stick to the supporting roll 28 and other parts it contacts. If additional heat is necessary, its upper surface is heated by the heaters 16 during its passage to the chip-applying unit 12. As the strip leaves the water bath 16*a*, it is lifted upwardly slightly and over a large roll 28 and directly beneath the chip-applying unit 12. The unit 12 receives the chips which are discharged over the edge 25 of the vibrator plate 18.

The chip-applying unit 12 consists mainly of a grooved distributing roll 30 which is driven continuously by suitable means. This roll extends transversely the full width of the vibratory plate 18 and is located directly below the discharge edge 25 of the plate. This roll 30 is supported by bearings carried on brackets 29 depending from the frame 22. It will be of a length slightly greater than the width of the strip S (FIG. 2). The grooves 31 formed in the roll 30 are disposed at angularly-spaced intervals around the roll and extend the full length of the roll.

The discharge edge 25 of the vibrator plate 18 will be located slightly rearwardly of the vertical diameter of the counter-clockwise rotating roll 30 (FIG. 3). The intent is to have the chips fall at about the vertical diameter of the roll 30 and placing the roll slightly forward of the edge 25 takes into account the momentum of the forwardly moving chips.

The rotating roll will fling the chips, supplied to the surface thereof, with considerable speed onto the softened surface of the continuously advancing strip S. The chips will be flung forwardly over the advancing strip in a path extending about three times the diameter of the roll and will settle onto the strip to form a uniform layer of flat contiguous chips on the strip which will adhere thereto because of the heat-softened surface thereof. The embodiments illustrated in the drawings show the drum projecting the chips C in the same direction as the movement of the strip S. However, the resulting coverage will be equally effective if the chips are projected in the opposite direction, that is, toward the advancing strip.

The coated strip will pass on over the roll 28 and beneath the grooved roll 30 and then upwardly around a pressure roll 35 of the unit 13. This roll 35 will engage the layer of chips and press them onto the softened surface of the strip to cause them to more firmly adhere to the strip. The strip will then pass around an idler roll 36 of the unit 14. This roll 36 has an air jet 32 associated therewith so tht any excess chips will be blown into a hopper 37 which has a vacuum conduit 38 connected thereto for collecting and removing the chips. The strip may then pass on to the pressure unit 13*a* which consists of a pair of pressure rolls 33 between which the strip passes to press the chips more firmly into the asphalt coating.

Figure 4:
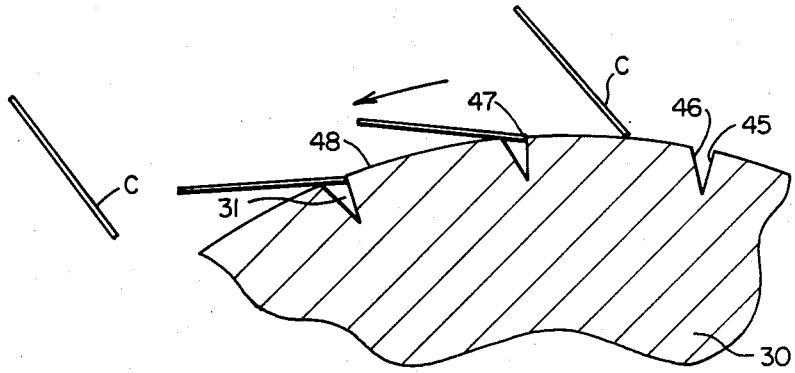
FIG. 4 is a fragmentary sectional view through the grooved chip-applying drum showing how it engages the chips that are applied thereto.

Looking to FIG. 4, each groove 31 is of V-cross-section and is provided with a trailing side 45 which is radially disposed in the roll and with a leading side 46 which is at an angle of approximately thirty degrees relative to side 45. Thus, when the chips settle down on the periphery of the roll as shown in FIG. 4, some will tend to rock into the groove and be engaged by the outer trailing shoulder or corner 47 at the wall 45 of the groove. Some, however, will fall edgewise directly into the groove. This engagement, due to the fast rotation of the roll, will fling the chips with considerable force outwardly over the advancing strip through a distance approximately three times the diameter of the roll as indicated in FIG. 3. When using chips of square or rectangular shape and the size indicated in said U.S. Pat. No. 4,215,084 of 20 to 30 mils by 1 to 2 mils thick, it has been found that the roll should be of a diameter of approximately 3 inches, the depth of the groove about 1/64 inch, its mouth about 1/128 inch and the grooves spaced about $\frac{1}{8}$ inch apart to provide a chip contact surface 48 between each pair of adjacent grooves. The same roll and groove size are preferable at least up to a chip size of 60 to 80 mils on a side.

The roll 30 is preferably rotated to provide a linear speed 3 or 4 times that of the strip but that is not the significant feature. What is significant is that the chips be projected away from the drum, over the strip, about 3 times the diameter of the drum. Generally speaking, the greater the throw distance, the more uniform the chip coverage. There are obvious limitations to this and with a three-inch roll 30, the chips will settle flatter and more uniformly if they are flung from four to twenty-two inches from the center line of roll 30. The feed of chips to the drum by the unit 15 is regulated to provide about 2 lbs. of the chips per 100 ft.$^2$ of the strip. Theoretically, 1.8 lb. per 100 ft.$^2$ of strip would give non-overlap full coverage of the asphalt surface of the strip if the chips are of the size indicated.

Larger sizes of chips, that is, above 200 mils on a side, would not be suitable as they would not withstand wind gusts sufficiently when the material is applied to a roof.

Figure 5:
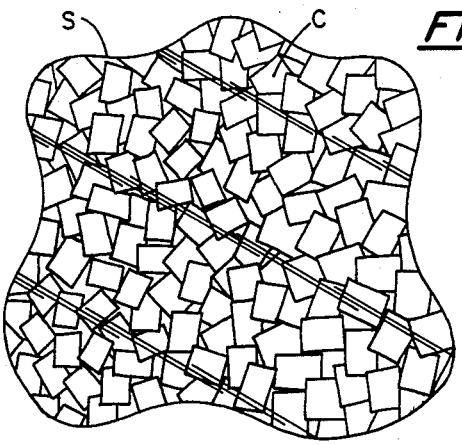
FIG. 5 is a plan view showing the chips applied to the roofing membrane.
Figure 6:
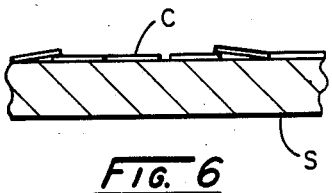
FIG. 6 is a sectional view taken through the completed roofing material of FIG. 5.

As the roll 30 rotates over the advancing strip S, the chips are flung thereon and most settle flat and adhere to the strip surface. An excess of chips is deposited on the strip S and will later be removed at the unit 14. The roll is located as close as possible to the softened surface of the strip by roll 28, for example, about one inch. The roll 30 rotating faster than the movement of the strip will receive the deposit of chips and the fast-moving trailing shoulders 47 will engage the chips as they tend to tilt into the grooves 31 (FIG. 4). This will fling and tumble these chips and any which fall edgewise into the grooves with considerable force over the surface of the strip (FIG. 3) and the chips will settle down onto the softened asphalt surface and adhere thereto to produce a layer of the flat chips substantially like that shown in FIGS. 5 and 6. The base material of the strip S will be covered by a layer of the flat chips in contiguous relationship with a minimum of overlap. The grooves 31 shaped as indicated will tend to cause the chips to travel over the strip in such a manner that they will settle flat onto the strip as a layer with few being on edge. The pressure applied by the roll 13 will produce further bonding and any surplus chips will be removed at the unit 14. Pressure rolls 33 will produce further bonding.

Thus, chips will be laid down uniformly on the base in contiguous relationship with minimum overlapping so that a continuous protective reflective coating of flat chips results with the use of a minimum number of chips. The process of applying the chips is a simple continuous process using simple apparatus to effectively cover the base material with the chips applied uniformly and economically.

I claim:

1. A method of producing roofing material which comprises providing a base strip which has an adhesive surface and directing flat metal chips of rectangular shape onto said surface to provide a flat protective layer of the chips on the adhesive surface, moving the strip continuously beneath a rotating distributing roll and directing the chips continuously into contact with said roll prior to the time said chips are directed onto said surface, the roll being provided with grooves at angularly spaced positions around said roll to provide sides which engage the chips and fling them onto the adhesive surface of the strip to lay a uniform flat layer of the chips on the surface.

2. The method according to claim 1 in which the base strip has an asphalt surface and the chips are aluminum.

3. The method according to claim 2 in which the rectangular chips are of a size of about 10 to 200 mils on a side by 1 to 2 mils thick.

4. The method according to claim 3 in which the asphalt surface is tacky to receive the chips and the chips are pressed into the asphalt.

5. The method of claim 2 in which the roll has a center line and is driven at such speed that it projects the chips about four to twenty-two inches from the center line before said chips contact the strip.

6. The method of claim 1 in which the strip is moved in one direction beneath the roll and the roll is rotated in the opposite direction to fling the chips onto the oncoming strip surface.

7. The method of claim 1 in which a uniform stream of chips is deposited on the roll as it is rotated.

8. The method of claim 7 in which the grooves of the roll are of V-cross section and are spaced uniformly around the roll.

9. The method of claim 8 in which each V-cross section groove has a trailing side which extends radially of the roll so as to engage the chips and a leading side at an angle of approximately thirty degrees to the radially extending side.

10. The method of claim 9 in which the grooves are spaced apart about an eighth of an inch to provide a chip-contacting surface therebetween, and each groove is of a width at its outer side of about one-one hundred twenty-eighth inch and is of a depth of about one-sixty-fourth of an inch.

11. The method according to claim 1 in which the rectangular chips are of a size of about 10 to 200 mils on a side by 1 to 2 mils thick.

12. The method of claim 1 in which the grooves of the roll are of V-cross section and are spaced uniformly around the roll.

13. The method of claim 1 in which each V-cross section groove has a trailing side which extends radially of the roll so as to engage the chips and a leading side at an angle of approximately thirty degrees to the radially extending side.

14. The method of claim 1 in which the grooves are spaced apart about an eighth of an inch to provide a chip-contacting surface therebetween, and each groove is of a width at its outer side of about one-one hundred twenty-eighth inch and is of a depth of about one-sixty-fourth of an inch.

* * * * *